US007040951B2

(12) United States Patent
Hornsby et al.

(10) Patent No.: US 7,040,951 B2
(45) **Date of Patent: *May 9, 2006**

(54) AMUSEMENT DEVICE

(76) Inventors: James R. Hornsby, No. 2 Ballantrae Dr., St. Louis, MO (US) 63131; Daniel J. Beckman, 3128 Maury Ave., St. Louis, MO (US) 63116; Marcellus R. Benson, 15058 Manor Creek Dr., Chesterfield, MO (US) 63017; William H. Bronson, Jr., 7594 Watson Rd., Apt. 308, St. Louis, MO (US) 63119

( * ) Notice: Subject to any disclaimer, the term of this patent is extended or adjusted under 35 U.S.C. 154(b) by 209 days.

This patent is subject to a terminal disclaimer.

(21) Appl. No.: 10/751,351

(22) Filed: Jan. 5, 2004

(65) Prior Publication Data

US 2004/0198169 A1 Oct. 7, 2004

Related U.S. Application Data

(63) Continuation of application No. 09/777,144, filed on Feb. 5, 2001, now Pat. No. 6,672,934.
(60) Provisional application No. 60/180,307, filed on Feb. 4, 2000.

(51) Int. Cl.
*A63H 30/00* (2006.01)

(52) U.S. Cl. ..... 446/454; 446/132; 446/368
(58) Field of Classification Search ..... 446/454, 446/132, 137, 139
See application file for complete search history.

(56) References Cited

U.S. PATENT DOCUMENTS 2,519,883 A * 8/1950 Bustanoby ..... 446/132
2,618,099 A * 11/1952 Samet ..... 446/132
2,909,868 A * 10/1959 Lewis ..... 446/139
3,266,187 A * 8/1966 Felsher ..... 446/130
3,867,786 A * 2/1975 Greenblatt ..... 446/130
4,132,032 A * 1/1979 Triska ..... 446/132
4,708,685 A * 11/1987 Udagawa ..... 446/139
4,820,232 A 4/1989 Takahashi et al.
5,141,464 A 8/1992 Stern et al.
5,297,981 A 3/1994 Maxim et al.
5,439,408 A 8/1995 Wilkinson
5,524,326 A * 6/1996 Markowitz ..... 119/707
5,676,582 A 10/1997 Lin
5,765,508 A 6/1998 Markowitz
6,017,262 A * 1/2000 Starnes ..... 446/308
6,220,921 B1 4/2001 Kim
6,273,782 B1 8/2001 Chan et al.
6,386,937 B1 * 5/2002 Cappello et al. ..... 446/139
6,672,934 B1 * 1/2004 Hornsby et al. ..... 446/300
6,682,387 B1 * 1/2004 Choi ..... 446/175

* cited by examiner

*Primary Examiner*—A. L. Wellington
*Assistant Examiner*—Ali Abdelwahed
(74) *Attorney, Agent, or Firm*—Dorsey & Whitney LLP

(57) ABSTRACT

An amusement device is disclosed having an animal body portion and a remote control portion. The animal body portion may be a lizard having horns and a tail. A user may use the remote control to cause the animal to move. The animal body has at least one motor operably connected to the animal's head, legs, and tail. The motor causes the animal to walk forward, walk backward, or dance in place at the selection of the user, and causes the tail to move and the mouth of the animal's head to move. An extendable tongue protrudes from the mouth. The tongue may have a magnetic tip for connecting with a magnetic or metallic object. The device may also contain a speaker that plays music and/or words as selected by the user through the remote control. In one embodiment, the lizard dances while playing music.

16 Claims, 11 Drawing Sheets

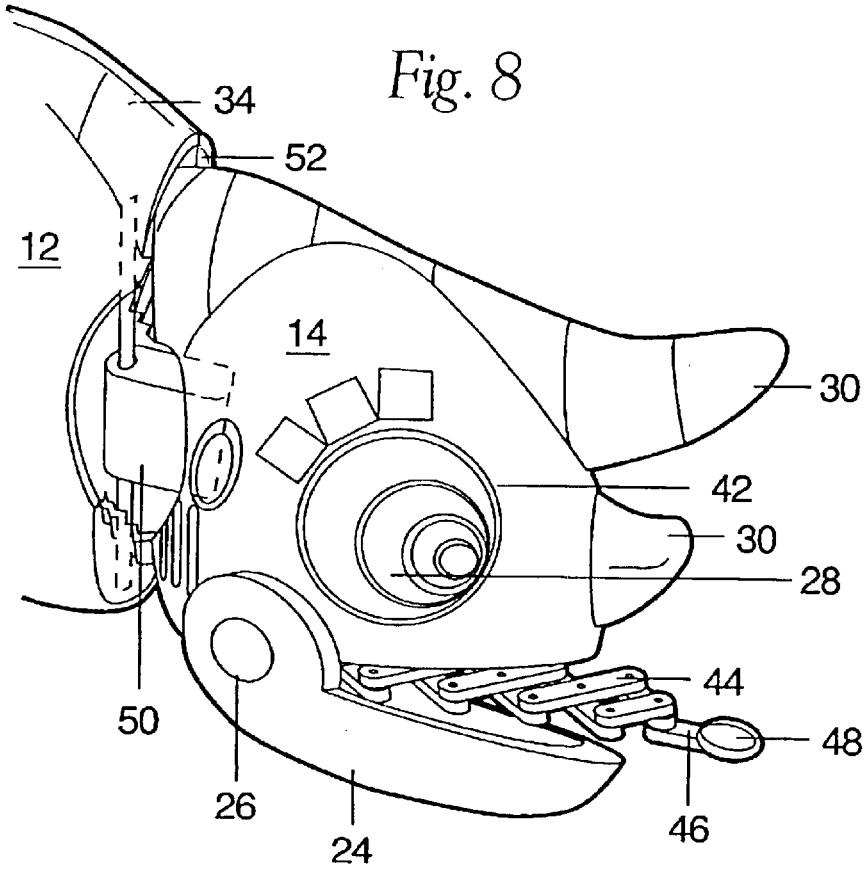
Fig. 8
Fig. 9a
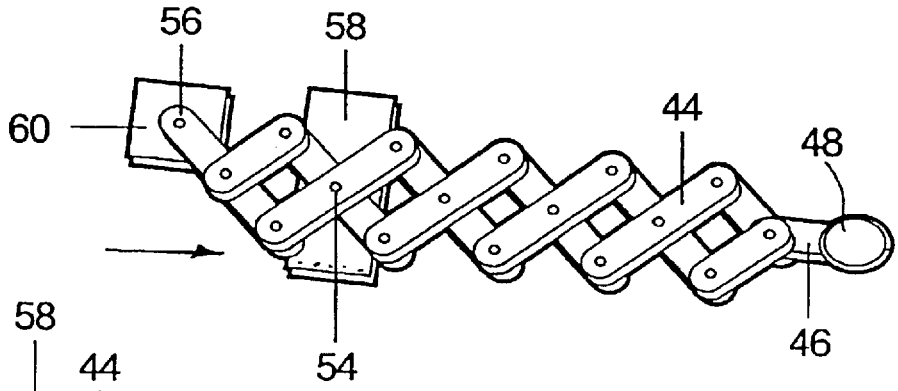
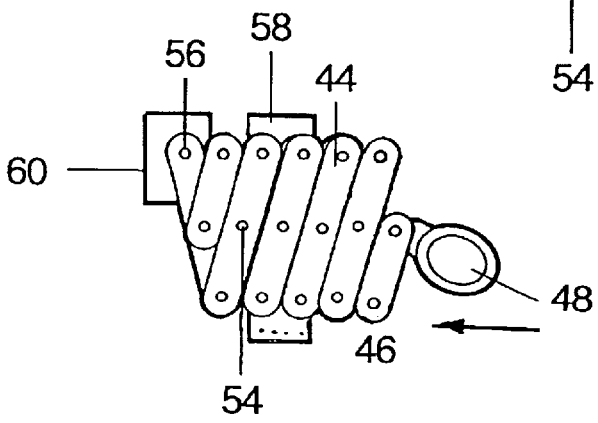
Fig. 9b 80
82
14
68
50
78
28
84
86
86
60
48
56
58
54
44

62
40
42
34
64
36
10
88
66

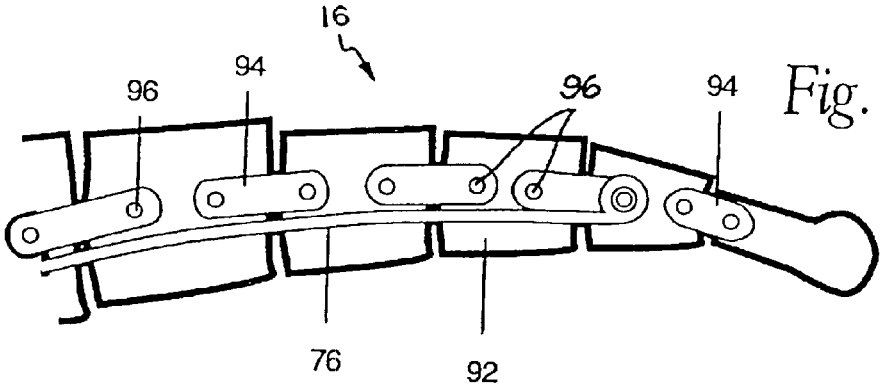
Fig. 17
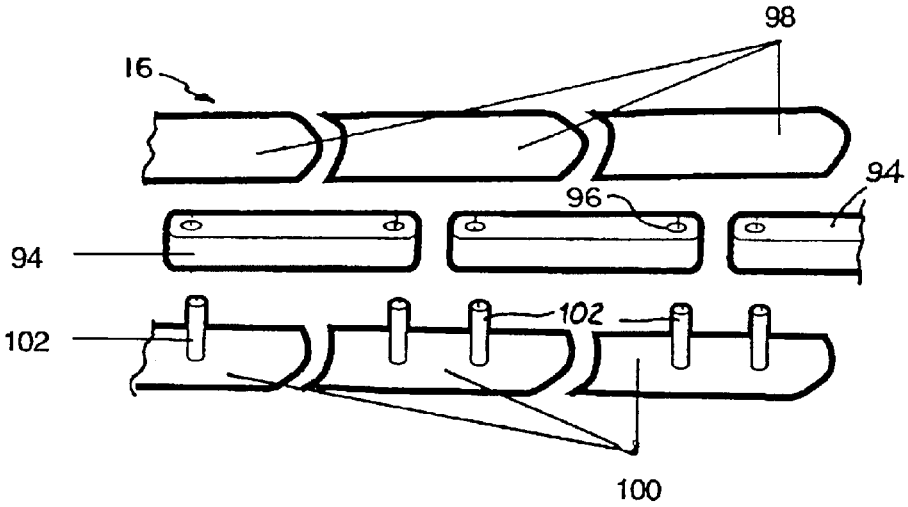
Fig. 18
Fig. 19
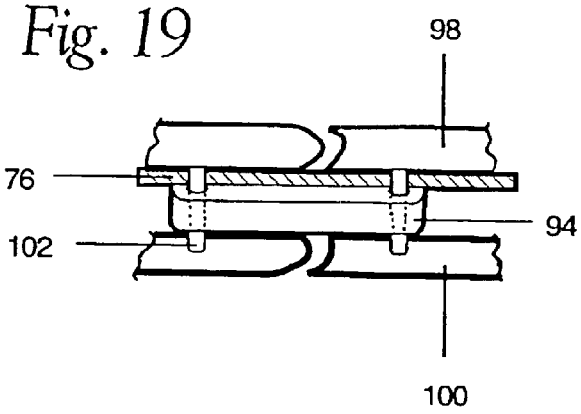
Fig. 20
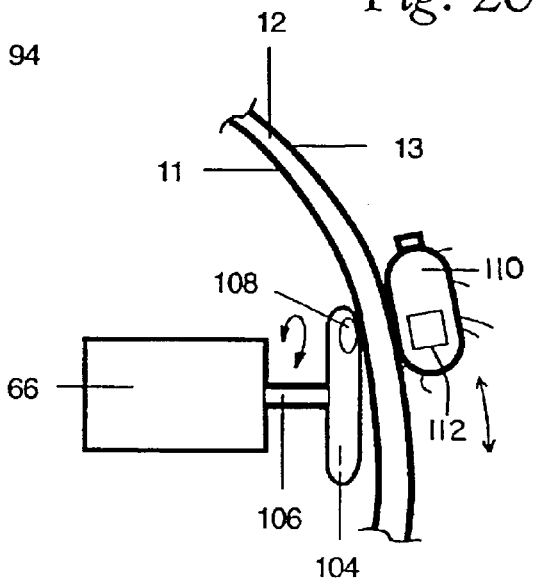

AMUSEMENT DEVICE

This application is a continuation of Ser. No. 09/777,144, filed Feb. 5, 2001 now U.S. Pat. No. 6,672,934, which claims the benefit of now abandoned provisional application Ser. No. 60/180,307 filed Feb. 4, 2000.

FIELD OF INVENTION

The present invention relates generally to amusement devices. More particularly, it relates to electro-mechanical amusement devices having moving parts operated by a remote control.

BACKGROUND

Remote controlled interactive amusement devices are well known. Typical amusement devices include radio frequency remote controlled race cars and the like. Existing types of toys focus primarily on motorized vehicles such as race cars. Very few interactive remote controlled toys involve a remote controlled pet or animal. Those that involve animals tend to be expensive and difficult to build. What is needed is an inexpensive remote controlled interactive pet toy.

SUMMARY OF INVENTION

An amusement device is disclosed having an animal body portion and a remote control portion. The animal body portion may be a lizard having horns and a tail. A user may use the remote control to cause the animal to move. The animal body has at least one motor operably connected to the animal's head, legs, and tail. The motor causes the animal to walk forward, walk backward, or dance in place at the selection of the user. The motor also causes the tail to move, the eyes to roll, and the mouth of the animal's head to move. In one embodiment, an extendable tongue protrudes from the mouth and is operated by the motor. The tongue may have a magnetic tip for connecting with a magnetic or metallic object. In one embodiment, the animal is a lizard, and a lightweight magnetic fly may be used in conjunction with the animal, such that the animal retrieves the fly from the ground surface using its magnetic tongue, as extended by the user. The magnetic fly also attaches to the outside of the body by a magnet inside the body, which magnet may move by a motor, causing the fly to move about on the body of the animal. The animal body may also contain a speaker and sound recording. The speaker may play music and/or words as selected by the user through the remote control. In one embodiment, the lizard dances while playing music.

SUMMARY OF DRAWINGS

FIG. 8 shows a side view of the head of the animal portion of the amusement device.

FIGS. 9A and 9B show the tongue of the animal portion of the amusement device.

FIG. 17 shows the linkage of the segmented tail.

FIG. 18 shows another view of the linkage system of FIG. 17.

FIG. 19 shows another view of the linkage system.

FIG. 20 shows a block diagram of the attachment of a magnetic object to the body.

DETAILED DESCRIPTION

Features and advantages of the amusement device apparatus and method of the present invention will become more fully apparent and understood with reference to the above-referenced drawings, this description and the descriptive material enclosed herewith, including the described embodiments of an interactive amusement device (which also may be referred to as a toy), and the description of the method or process by which the toy operates.

As used herein, the terms "robot" or "robotic" are intended to encompass mechanisms for performing tasks, including mechanisms guided or operated by controls, including automatic controls, so that they appear to function or operate of their own volition or to be animated.

The accompanying Figures and descriptive material depict and describe embodiments of the amusement device of the present invention, and features and components thereof. With regard to fastening, mounting, attaching or connecting the components of the present invention to form the apparatus as a whole, unless specifically described otherwise, the invention may incorporate or use conventional fasteners such as screws, nut and bolt connectors, machined connectors, snap rings, clamps such as screw clamps and the like, rivets, toggles, pins and the like. Components may also be connected by adhesives, sewing, welding, friction fitting or deformation, if appropriate. Electrical features and functions may be accomplished by using suitable electrical devices, including printed circuits, pc boards, chips and the like, and electrical connections may be made using appropriate electrical components and connection methods, including available components, connectors and connecting methods. Unless specifically otherwise disclosed or taught, materials for making components of the present invention are selected from appropriate materials such as metal, metallic alloys, fibers, fabrics, plastics and the like, natural or synthetic, and appropriate manufacturing or production methods including casting, extruding, weaving, spinning, molding and machining may be used.

Any references to front and back, right and left, top and bottom and upper and lower are intended for convenience of description, not to limit the present invention or its components to any one positional or spacial orientation.

Figure 1:
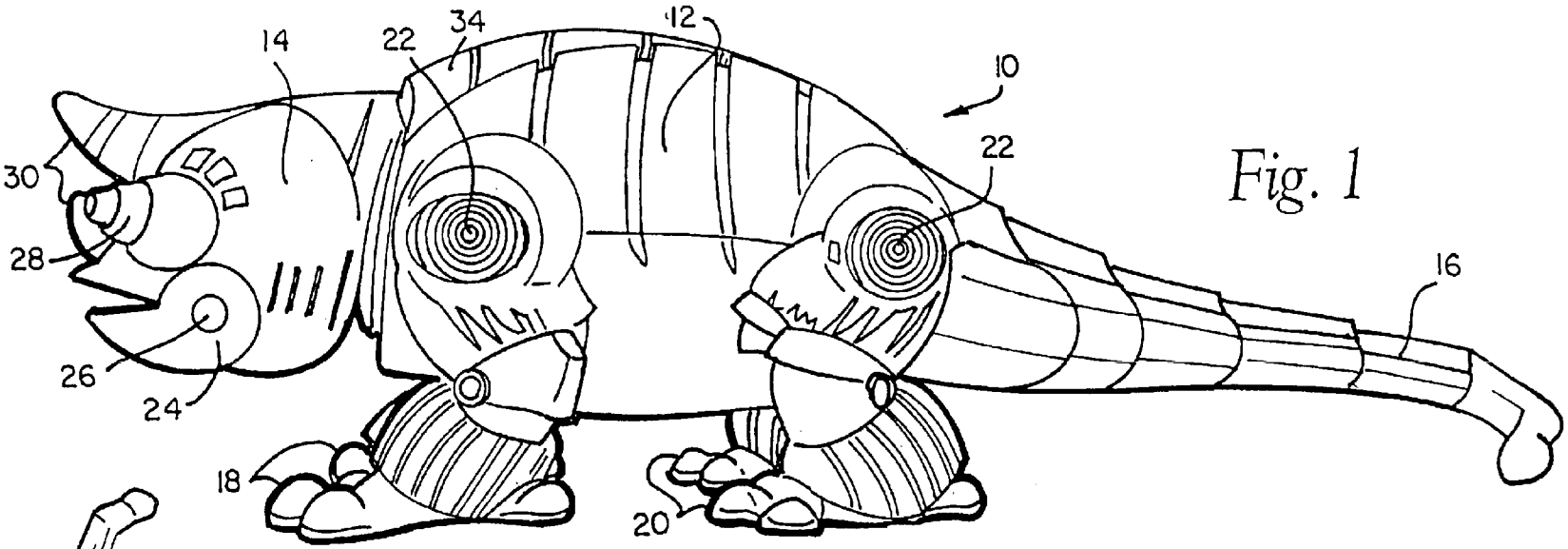
FIG. 1 shows a side view of the animal portion of the amusement device.
Figure 2:
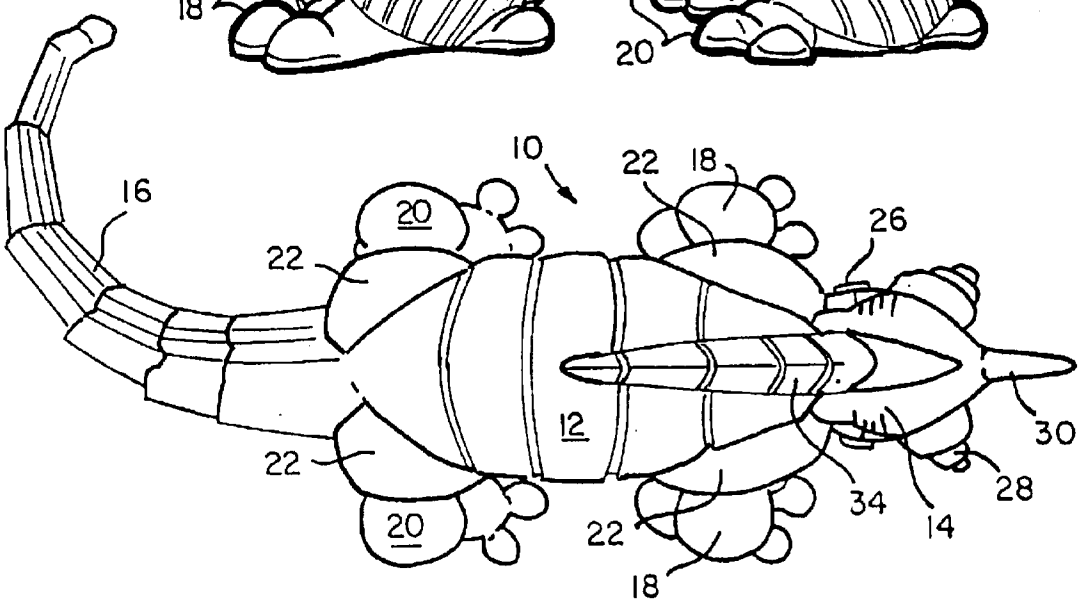
FIG. 2 shows a top view of the animal portion of the amusement device.

FIG. 1 shows a side view of the animal (also referred to as the "lizard" or "chameleon") portion 10 of the amusement device. The lizard portion 10 comprises a body portion 12 and a tail portion 16 connected to the body portion 12. The lizard portion 10 also has a head portion 14 connected to the front part of the body portion 12. Also connected to the body portion 12 are front legs 18 and rear legs 20. The legs 18, 20 are connected to the body portion 12 by joints 22. The head 14 of the lizard 10 has a mouth defined by lower jaw 24 connected to the head 14 by a jaw joint 26. The head portion 14 also has generally circular eyes 28 and horns 30. The body portion also has a receiver, such as an infra-red (IR) receiver 34 or a radio frequency receiver 34. The receiver 34 receives a signal from a transmitter instructing the lizard 14 to take certain action. FIG. 2 shows a top view of the lizard 10 shown in FIG. 1.

Figure 3:
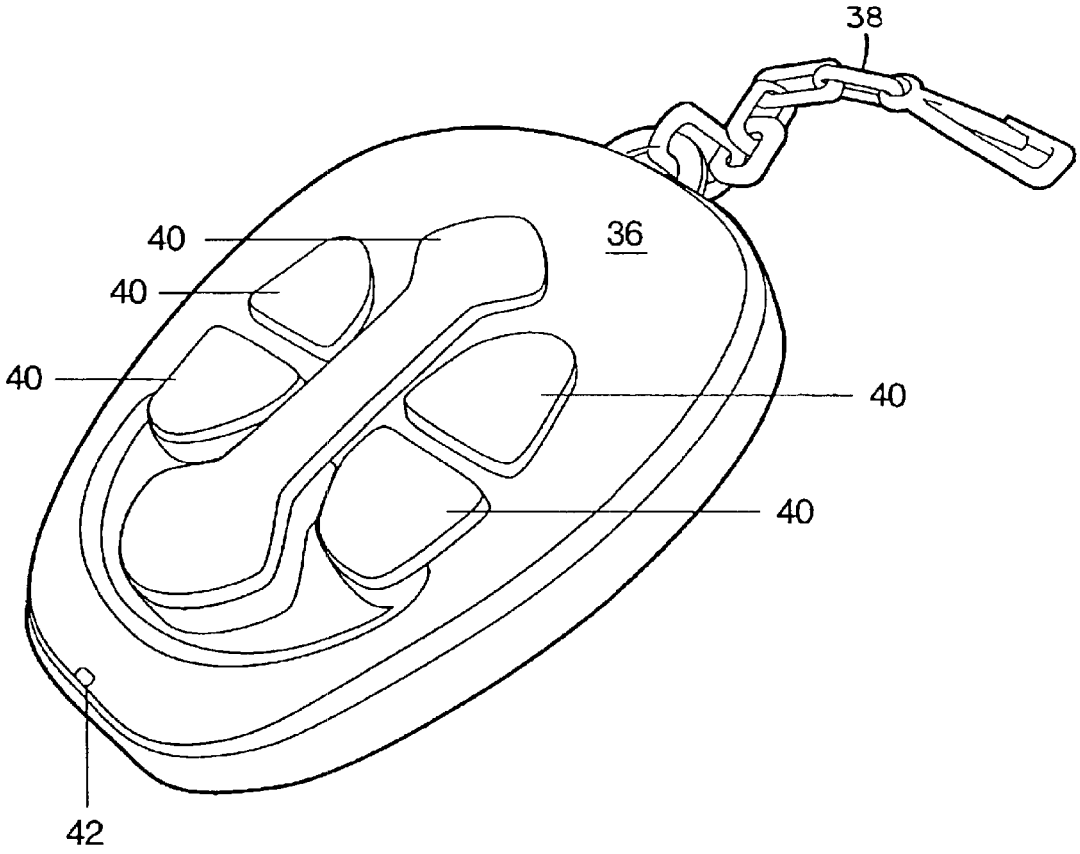
FIG. 3 shows the remote control.

FIG. 3 shows the remote control portion 36 of the amusement device. In the embodiment shown in FIG. 3, a key chain attachment 38 is attached to one end of the remote control device 36 for the convenience of a user. The remote control device 36 has a transmitter 42, such as an IR transmitter 42, for sending signals to the lizard portion 10. The remote control 36 may send various signals to the lizard portion 10 causing the lizard portion 10 to perform various functions. Different signals are sent by using different signal buttons 40 on the remote control device 36. In one embodiment, these functions may include dancing, talking, walking forward, walking backward, and extending a tongue of the lizard 10. In use, the dancing function may cause the lizard 10 to play music through a speaker located on the lizard 10 and to move mechanically about its legs 18, 20 such that the lizard 10 appears as though it is dancing. The talking function may cause the lizard 10 to play various sounds, including words, music, etc. While talking, the lizard 10 may also move its mouth by moving the lower jaw portion 24 about the jaw joint 26. The lizard's eyes 28 may also spin around while performing any of the functions. The walk-forward function may cause the lizard 10 to walk forward, and the walk-backward function may cause the lizard 10 to walk backward. The lizard's head 14 may also contain a tongue located in the mouth and concealed by the lower jaw 24. The extend tongue function on the remote control 36 may cause the lizard's tongue to extend outwardly. In one embodiment, the end of the lizard's tongue has a magnet for connecting to another magnetic or metal device. In one embodiment, a small magnetic fly may be included for removably attaching to the tongue.

Figure 4:
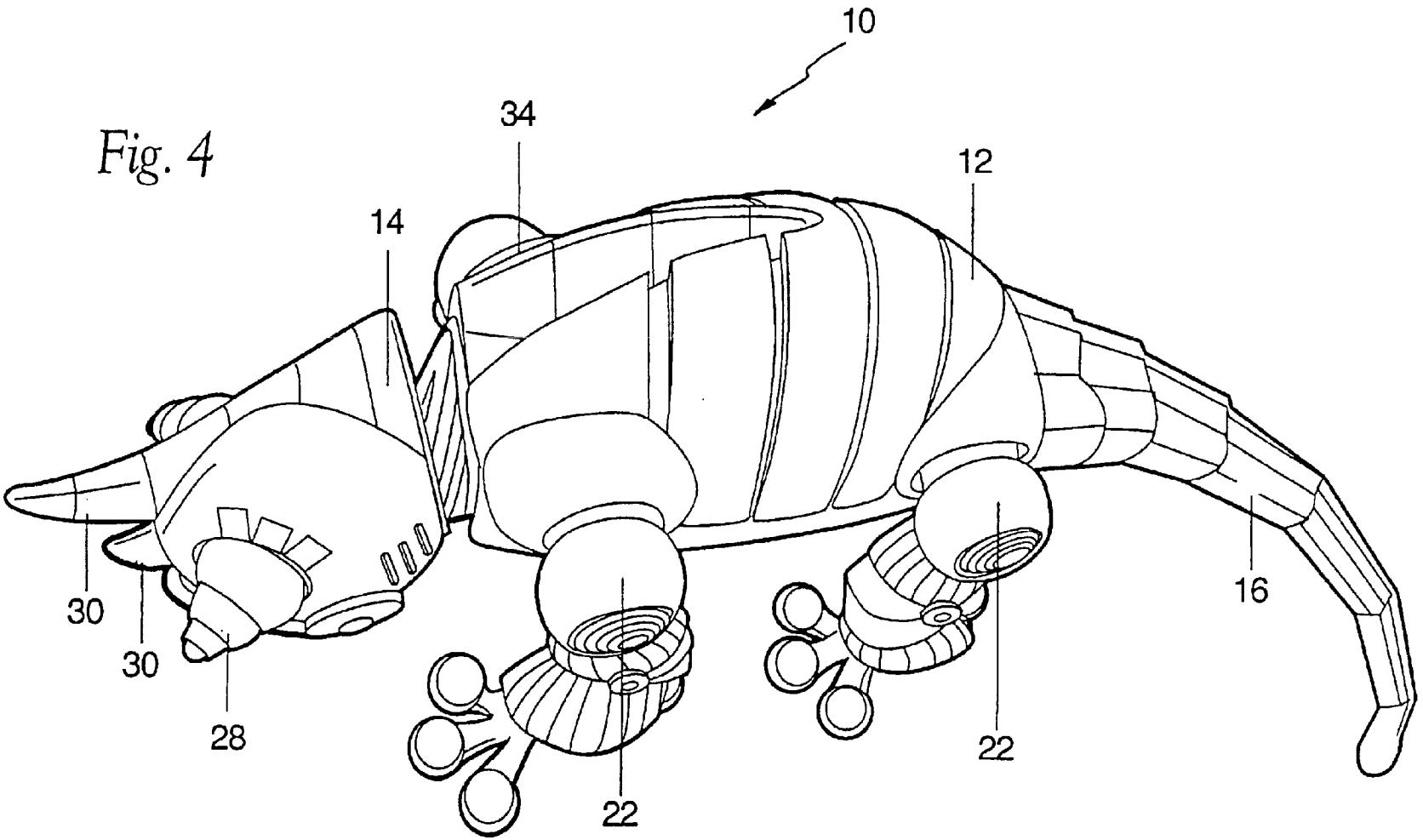
FIG. 4 shows another top view of the animal portion of the amusement device.
Figure 5:
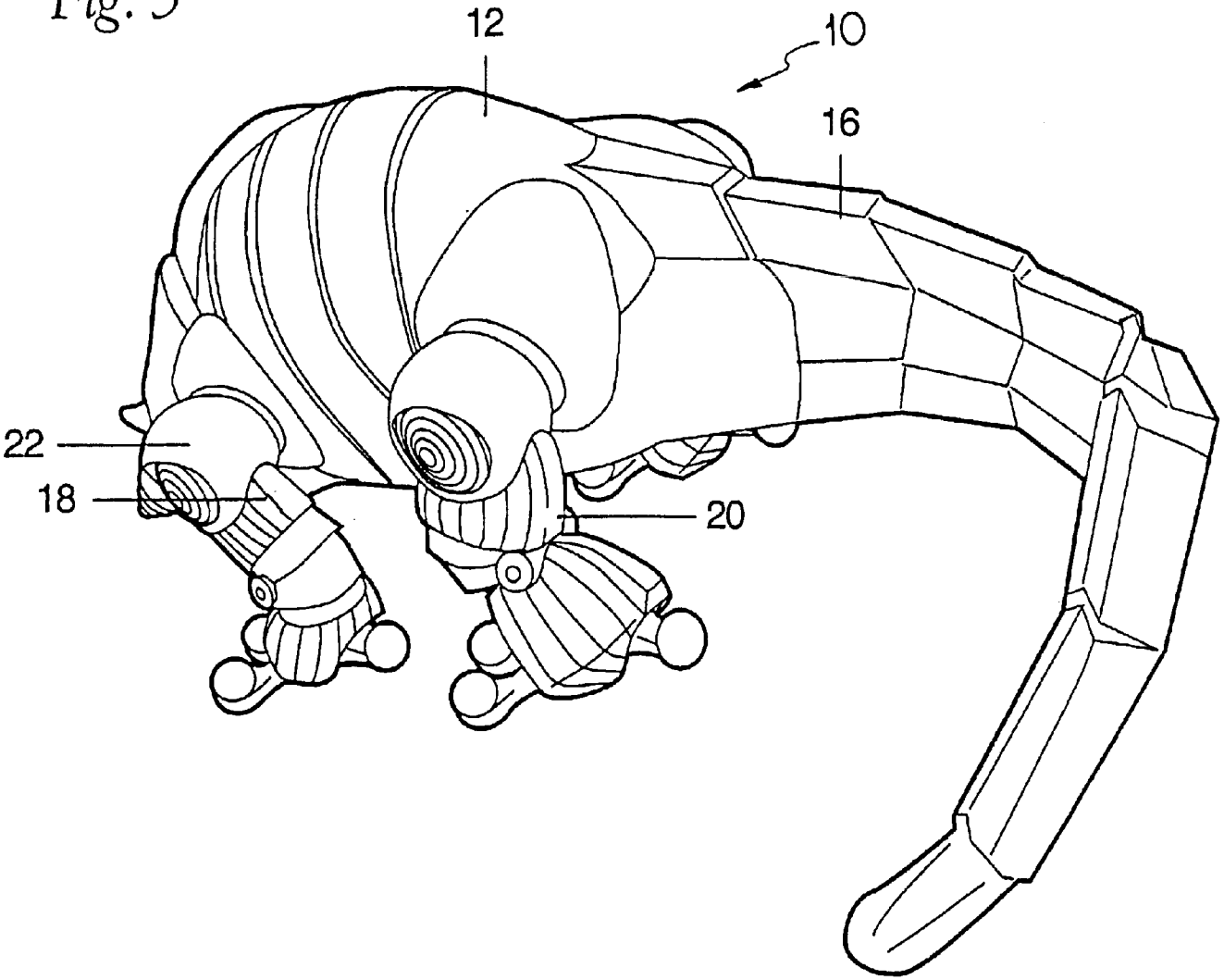
FIG. 5 shows a rear view of the animal portion of the amusement device.
Figure 6:
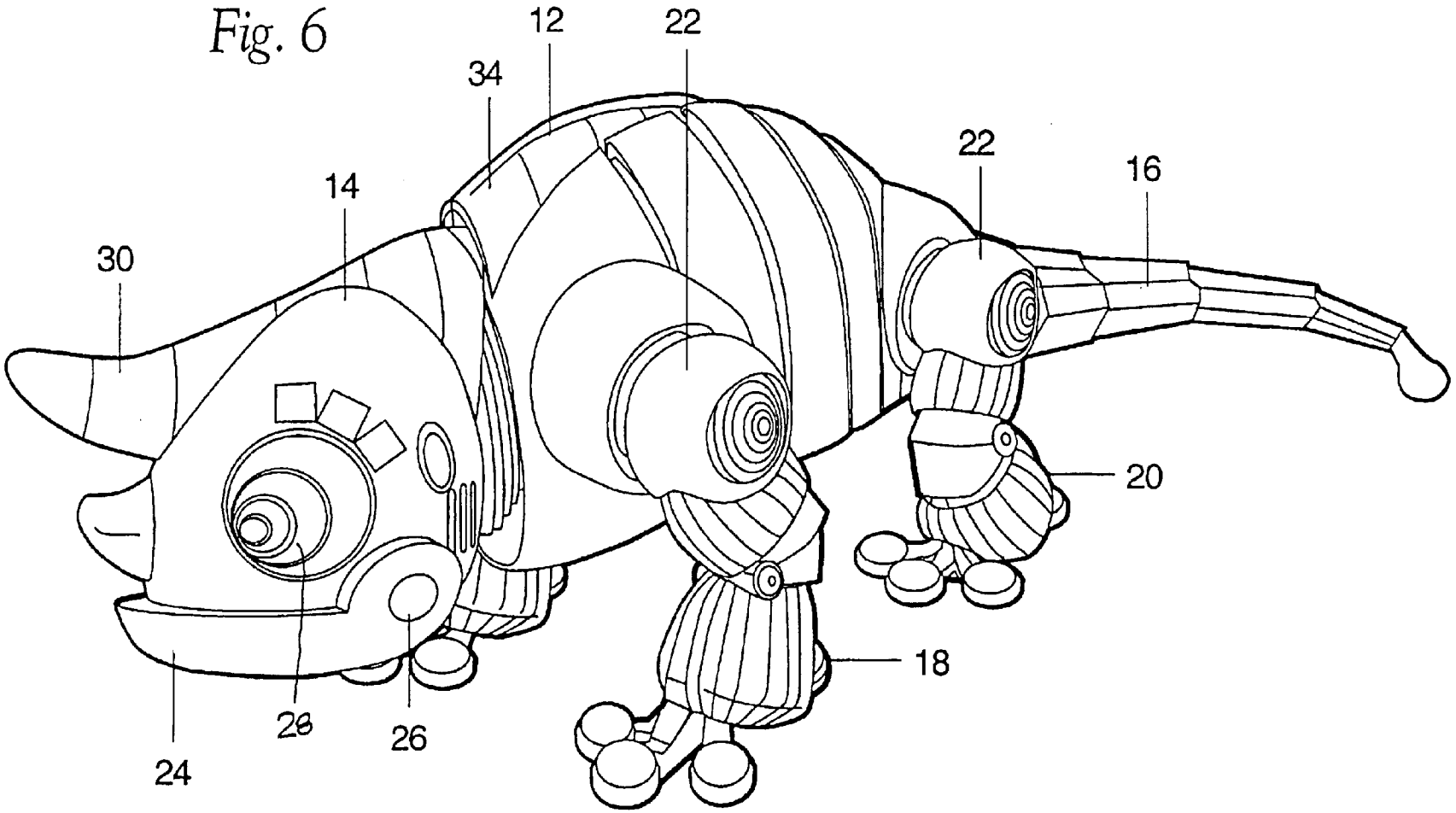
FIG. 6 shows a front side view of the animal portion of the amusement device.
Figure 7:
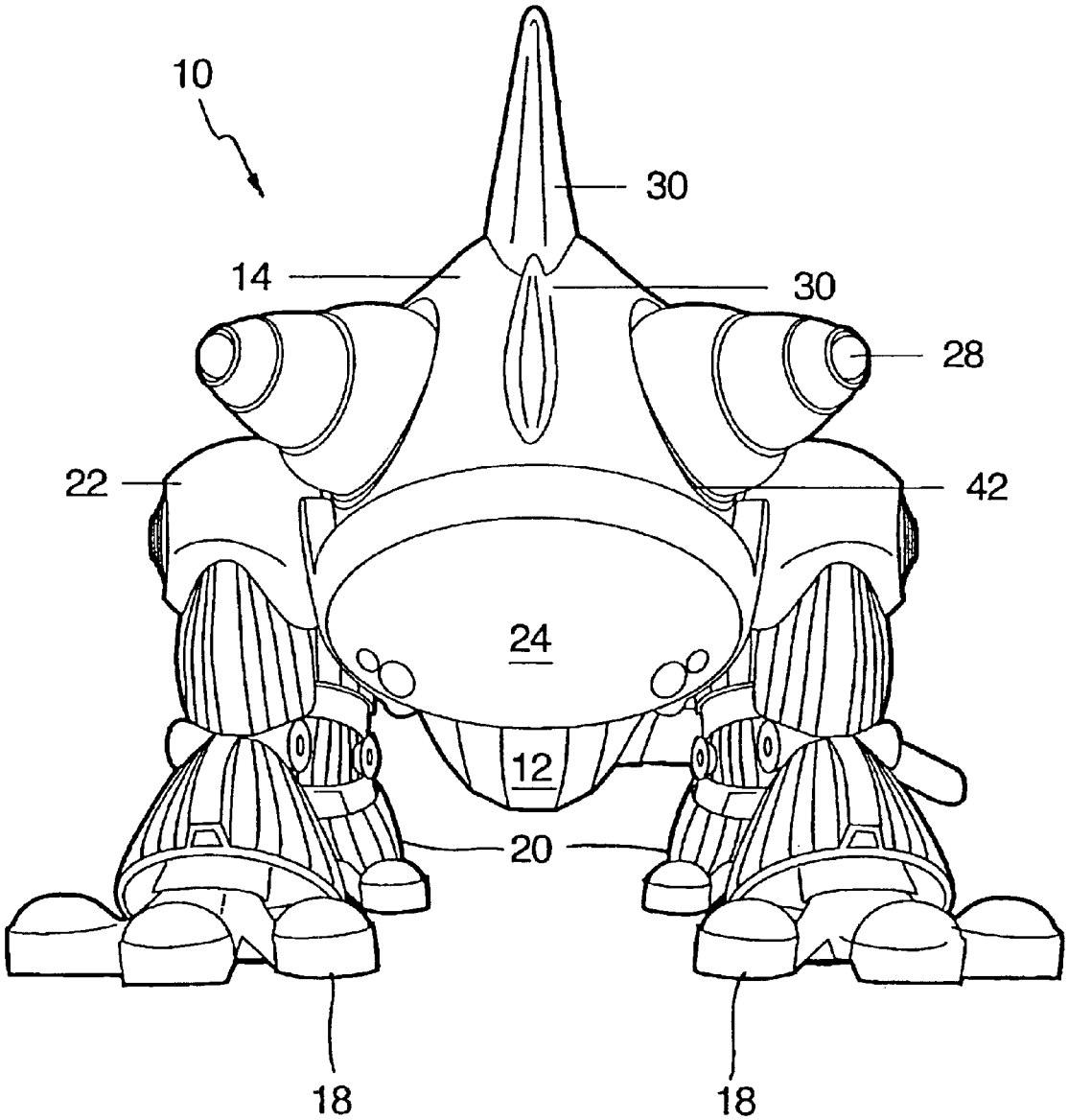
FIG. 7 shows a front view of the animal portion of the amusement device.

FIGS. 4, 5, 6, and 7 show various views of the outside of the lizard portion 10. FIG. 4 shows a side view looking down at the side of the lizard 10, the tail 16 is elongated and has a plurality of segments connected to each other. FIG. 5 shows a view of the rear of the lizard 10, again illustrating the segmented tail portion 16. FIG. 6 shows a view of the front side of the lizard 10. FIG. 7 shows a front view of the lizard 10. Again, the embodiment shown in FIG. 7 has two horns 30 protruding from the head 14. The eyes 28 also protrude from the head 14. The eyes 28 are shown having three concentric cylindrical, donut-like portions which are pivotally coupled to the head 14, and which rest in eye sockets 42 of the head 14. In one embodiment, the eyes 28 may be connected to each other via a central axis and operably coupled to a motor, which causes the eyes 28 to roll in the head 14.

FIG. 8 shows a view of the head 14 with the tongue 44 protruding from the mouth. As shown, the tongue 44 enters the mouth above the lower jaw 24. The tongue 44 may have a front portion 46, which may have a magnetic portion 48. As also shown in FIG. 8, the head 14 may be pivotally coupled to the body 12 by a head connector 50. Also, the receiver 34 may be located near the front portion of the body 12 and may be covered by a translucent cover 52. In one embodiment, the translucent cover 52 is shaped generally like the horns 30 on the head 14.

FIG. 9A shows the tongue 44 in an extended position. The tongue 44 may comprise a series of lattice-connected members which may be pinned to each other to allow the tongue 44 to extend and retract. The rear portion of the tongue 44 may be attached pivotally to a stationary member 60, fixably connected to the head 14. A rear pin 56 may be used to pivotally couple the rear portion of the tongue to the stationery member 60. Another portion of the tongue 44 may be pivotally connected to a slidable member 58, which member 58 is connected to the tongue 44 by a forward pin 54. In use, the slidable member 58 may move longitudinally relative to the length of the tongue 44 such that moving the slidable member 58 causes the tongue 44 to extend or retract. In one embodiment, the tongue 44 may have a spring (not shown) to urge it into a retracted position. FIG. 9B shows the tongue 44 in a retracted position. The individual tongue members abut each other, and the slidable member 58 has moved back closer to the stationary member 60. In the retracted position, the tongue 44 may be entirely concealed within the mouth of the head 14 by the lower jaw 24. In the extended position, the tongue 44 may extend out of the mouth of the head 14, and in one embodiment the magnetic portion 48 on the tip 46 of the tongue 44 may be used to retrieve magnetic items.

Figure 10:
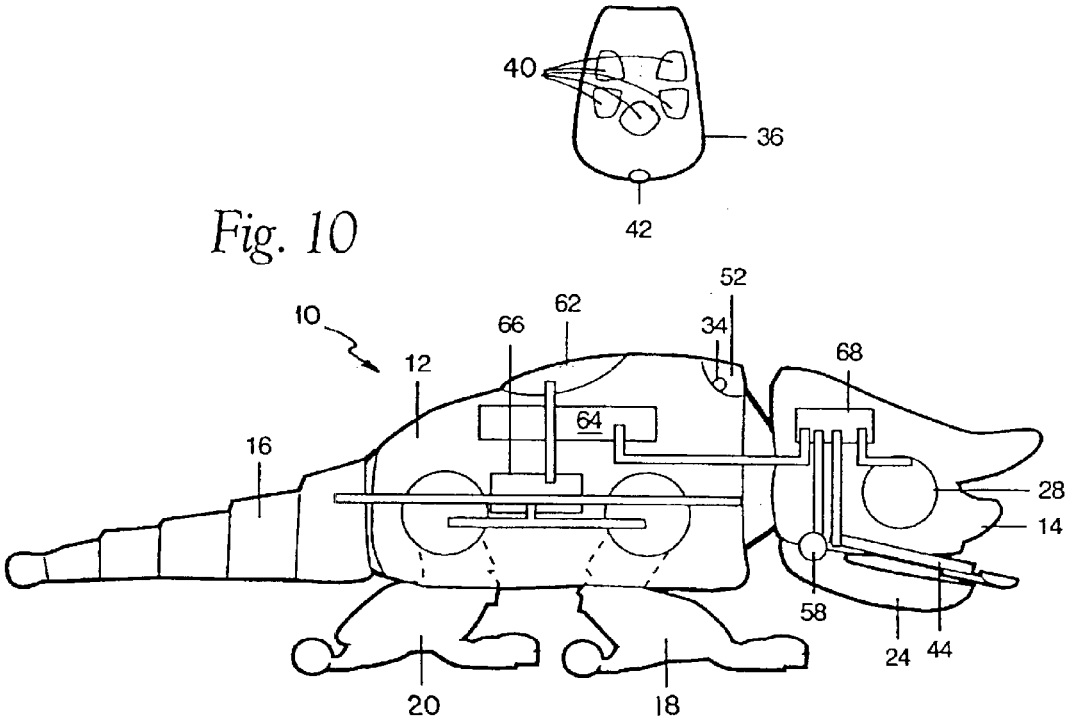
FIG. 10 shows a diagram of the interaction between the remote control and the animal portion.

FIG. 10 shows a diagram of the relationship between the lizard 10 and the remote control 36. In one embodiment, the remote control 36 sends signals using the buttons 40, which transmit the signal using an IR transmitter 42 to the lizard 10. An IR receiver 34 of the lizard 10 receives the signal sent by the remote control 36 and sends it to an electronic circuit portion 64 where it is processed. The lizard 10 also has a speaker 62 in the body 12 for creating sounds, such as sounds that may be selected using the buttons 40 of the remote control 36. The electronics portion 64 also controls a body motor 66 and a head motor 68. The body motor 66 is connected to the front and rear legs 18, 20 of the lizard 10. The body motor 66 is also connected to the tail 16 of the lizard 10, and to the head 14. In use, the motor 66 causes the tail 16 and the head 14 to move pivotally about the body 12. The body motor 66 may also cause the front and rear legs 18, 20 to move, thereby causing the lizard 10 to walk forward or backward or to appear as though it is dancing. The head motor 68 is also controlled by the circuit portion 64. The head motor 68 is connected to the eye 28, the tongue 44, and the lower jaw portion 24. In use, the head motor 68 causes the eyeballs 28 to spin, causes the lower jaw 24 to open and close, and causes the tongue 44 to extend and retract.

Figure 11:
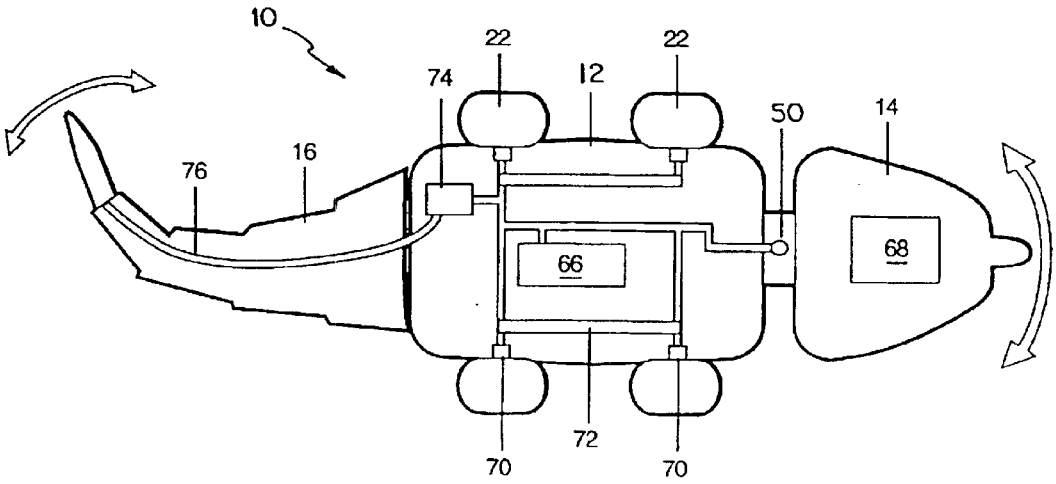
FIG. 11 shows a block diagram of the mechanical connections in the animal portion.

FIG. 11 shows a block diagram of the motor connections within the lizard 10. The body motor 66 is connected to the leg joints 22 by leg drive mechanism 72 which interface with gears 70 connected to the joints 22. In use, movement of the leg drive mechanism 72 caused by the body motor 66 causes the legs 18, 20 to move about the joints 22. The body motor 66 is also coupled to a tail gear 74. The tail gear 74 drives a tail drive mechanism 76 which causes the tail to move back and forth. The body motor 66 is also coupled to the head connection 50. In use, the body motor 66 causes the head 14 to pivot about the head connection 50, such that the head moves back and forth.

Figure 12:
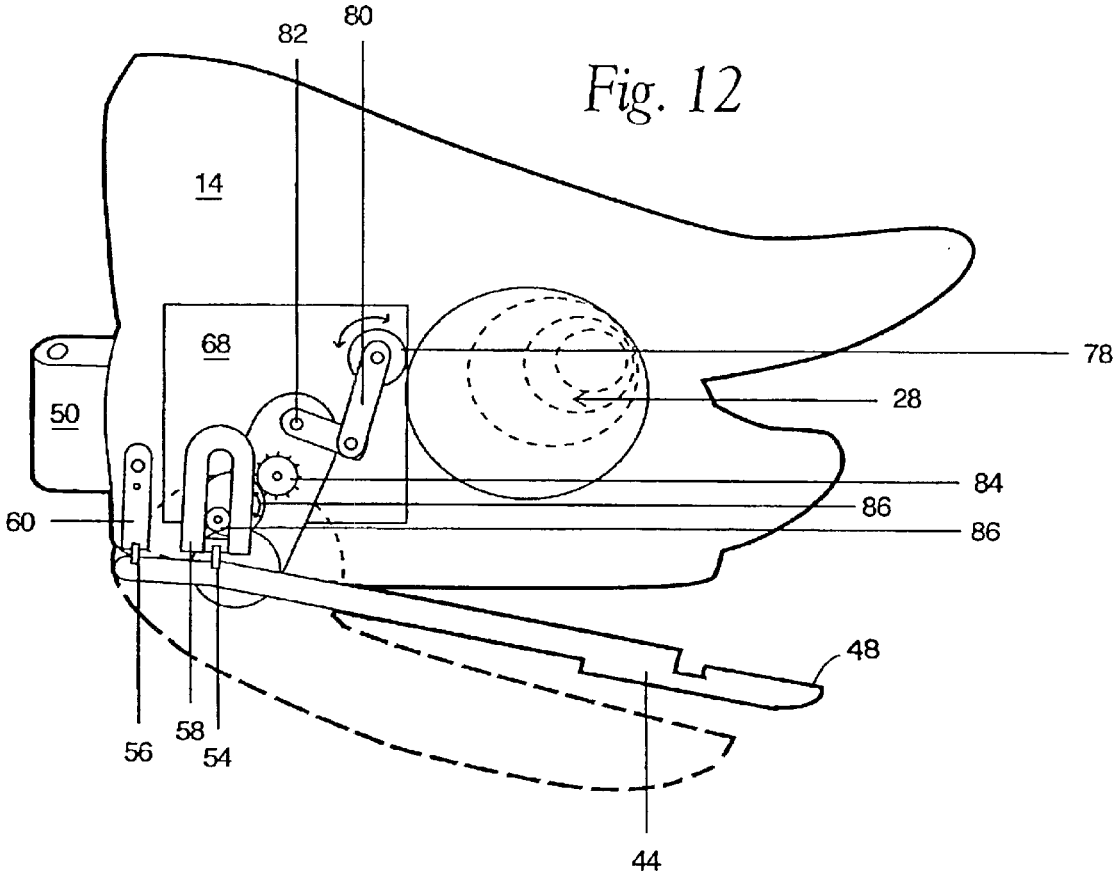
FIG. 12 shows the mechanical features of the head.

FIG. 12 shows a block diagram of the motor mechanism in the head 14. The head motor 68 is connected to the eyes 28, the tongue 44, and the lower jaw 24. An eye drive gear 78 causes the eye 28 to move. In one embodiment, both eyes are connected via a common access such that they move in unison. The eye drive gear 68 may also be connected to rigid mouth movement members 80 which have a lower jaw interface 82. The interface 82 may have a flat portion that is received by the jaw connection 26 of the lower jaw 24. In use, movement of the eye drive gear 78 caused by the head motor 68 causes the lower jaw 24 to move up and down, thereby opening and closing the mouth of the head 14. The head motor 68 may also have a tongue drive gear 84, which may be connected to a slidable gear 86, which in turn may be connected to the slidable member 58 which causes the tongue to extend and retract. In use, the head motor 68 causes the tongue drive gear 84 to urge the tongue 44 inward and outward from the mouth.

Figure 13:
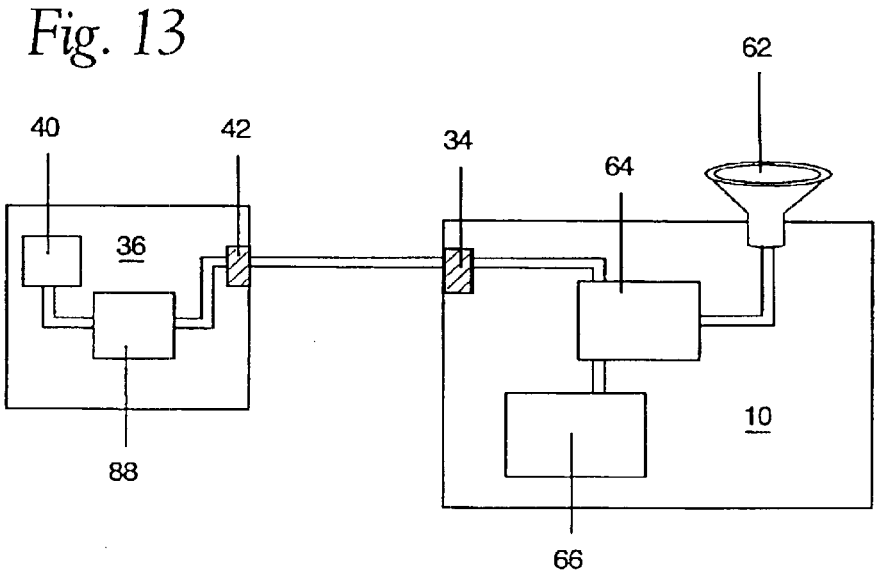
FIG. 13 shows a block diagram of the amusement device.

FIG. 13 shows a block diagram of the electro-mechanical connections of the amusement device. A remote 36 has at least one control button 40, which may be depressed by a user. The button 40 is connected to a remote circuit 88 that sends a signal corresponding to the button 40 to the transmitter 42. The transmitter 42 transmits the signal to the lizard 10. The lizard 10 receives the signal using the receiver 34 and sends the signal to the electronics portion 64. The electronics portion 64 identifies the function selected by the button 40 and causes the lizard 10 to perform the selected function, using a speaker 62 for making sounds and/or a body motor 66 for causing the lizard 10 to move. The lizard 10 may contain a plurality of motors, such as a separate body motor 66 and head motor 68, and may contain a plurality of speakers 62 located in various portions of the lizard 10.

Figure 14:
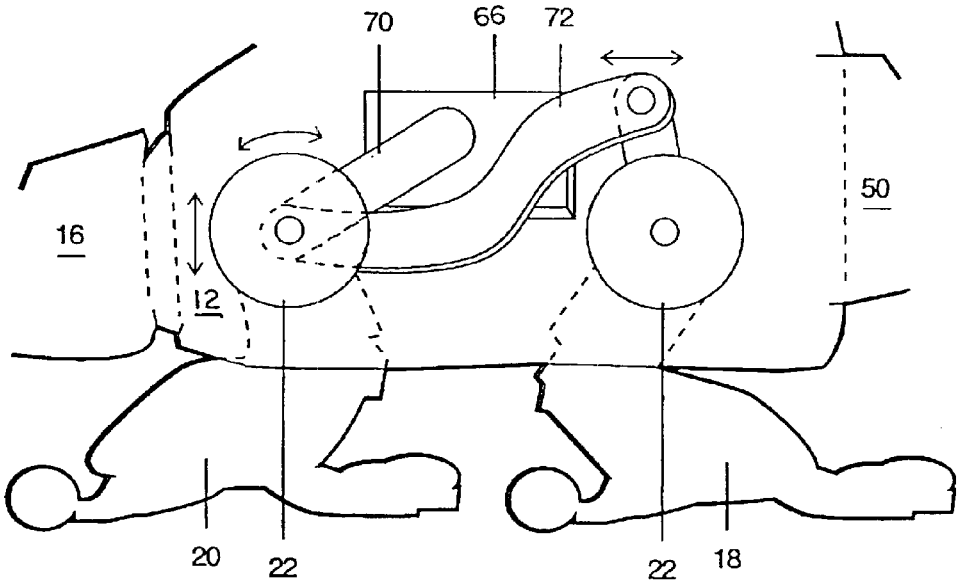
FIG. 14 shows the mechanical connection of the animal legs to the motor.

FIG. 14 shows a side view of the mechanical portions of the lizard 10 used for moving the legs 18, 20. The body motor 66 resides in the body 12 of the lizard 10 and is connected to the leg drive mechanisms 72 by connectors 70. In use, the body motor 66 spins causing the connectors 70 to spin. The central axis of the connectors 70 is offset relative to the joints 22, thereby causing the joints 22 to move forward, backward, up, and down as the body motor 66 turns. The rear joint 22 is also connected to the leg drive mechanism 72, which in turn is connected to the front leg connector 70 and the front leg joint 22. The leg drive mechanism 72 is a rigid elongated member. As the rear joint 22 moves it causes the leg drive mechanism 72 to move forward and backward relative to the body 12. The front leg connector 70 extends outwardly from the front joint 22 and is pivotally connected to the leg drive mechanism 72. The front joint 22 is also pivotally coupled to the body 12. The extension of the front connector 70 creates a lever action on the front leg 18 as the leg drive mechanism 72 moves. The leg drive mechanism 72 causes the front and rear legs 18, 20 to move synchronously, causing the lizard 10 to walk forward or backward.

Figure 15:
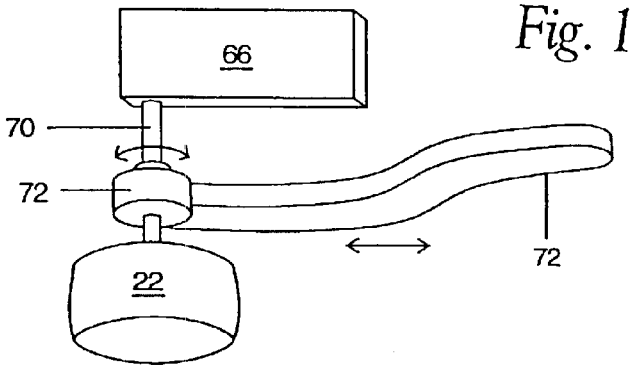
FIG. 15 shows the connection between the motor and the leg drive mechanism.

FIG. 15 shows a top view of the connection between the body motor 66 and the leg drive mechanism 72. As shown, the leg connector 70 is offset relative to the connector 22, causing the connector 22 to rotate in a circular or elliptical manner as the body motor 66 turns. The leg drive mechanism 72 is pivotally connected to the connector 70 and the joint 22, with a pivot point offset that of the motor 66 such that the drive mechanism 72 moves forward and backward as the motor 66 turns.

Figure 16:
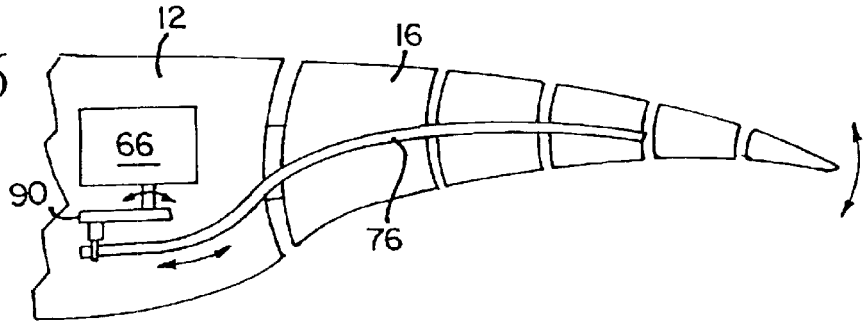
FIG. 16 shows the mechanical features of the tail.

FIG. 16 shows a top view of the tail drive mechanism 76, which is pivotally connected to the body motor 66 by a tail connector 90. The tail connector 90 is an offset gear that translates the body motor's circular movement into a lateral movement of the tail drive mechanism 76. The tail drive mechanism 76 is flexible yet rigid. It is rigid, as opposed to elastic, along its length to allow it to push and pull the tail 16. It is flexible allowing it to deflect sideways as the tail moves.

FIG. 17 shows a top view of the linkage system used in the tail 16. The tail 16 comprises a plurality of segments 92 as seen from the outside of the lizard 10. The segments 92 are connected with a series of tail connectors 94, which have holes 96 for pivotally connecting to the segments 92. The tail drive mechanism 76 runs alongside the tail connections 94, on one side or the other of the pivots. The tail drive mechanism 76 is connected to a tail segment 92 and may be pivotally connected to one of the pivots near the end of the tail 16.

FIG. 18 shows an exploded view of the linkage system. The tail segments 92 may comprise a top portion 98 and a bottom portion 100. Either of these portions 98, 100 may have a pivot 102 extending toward the other portion 98, 100. The pivot 102 couples with the hole 96 in the tail connector 94 to create a pivotal connection. FIG. 19 shows the relationship of the tail drive mechanism 76 to the linkage system. The tail drive mechanism 76 runs alongside the pivots 102 such that as the tail drive mechanism 76 moves laterally the tail 16 is urged side to side.

FIG. 20 shows a block diagram of a magnetic fly function of the device. The device may include a lightweight magnetic object 110, for example a fly-shaped device, having a magnetic portion 112. As noted above, the magnetic fly 110 may be used in conjunction with a magnetic portion 48 of the tongue 44. Also, an internal magnetic device 104 having a magnetic portion 108 may be connected via a connector 106 to the body motor 66, such that the body motor 66 causes the magnetic portion 108 to move relative to the side of the body 12. The body 12 may comprise a non-conducting shell, such as a plastic shell, having in inner side 11 and an outer side 13. The magnetic fly 110 attaches to the outer side 13 of the body 12 by a magnetic force created between the magnetic portion 112 of the fly 110 and the magnetic portion 108 of the internal magnetic device 104. In use, the inner magnetic device 104 moves its magnet 108 causing the fly 110 to move while staying in contact with the outer surface 13 of the body 12. The fly 110 may move, for example, when the animal 10 is walking or dancing.

In use, the lizard 10 may perform various functions selected by the buttons 40 on the remote 36. Sound such as words or music may be stored in a memory within the lizard 10 and may be played using the speaker 62. The lizard 10 may walk forward or backward, may extend its tongue 44, and may "dance" by moving its legs forward and backward while playing music.

The lizard 10 and the remote 36 may be powered by common battery systems and may be formed of plastic using, for example, an injection molding process. The parts of the amusement device may be connected using common connectors, such as screws, and adhesives.

The present invention may be embodied in other specific forms without departing from the essential spirit or attributes thereof. For example, outputs and inputs other than those described herein may be provided, for example, the receiver may be a motion sensor or sound sensor, and the input may be a movement or a sound, rather than a signal transmitted from a remote control. The lizard figure may take the form of "plush" toys, human or animal figures, or whimsical figures. It is desired that the described embodiments be considered in all respects as illustrative, not restrictive.

We claim:

1. An electro-mechanical amusement device comprising:

an animal portion comprising:

a body portion;

a head connected to the body portion;

a tail connected to the body portion;

legs connected to the body portion;

a receiver for receiving a signal; and a motor for causing the animal portion to move based upon the signal;

a remote control that interfaces with the animal portion comprising:

a button for selecting a feature; and a transmitter connected to the button for transmitting the signal to the receiver and the animal portion further comprising a tongue operably coupled to the motor, the tongue comprising a plurality of elongated members connected as a lattice that extends and retracts.

2. The amusement device of claim 1, wherein the tail and the head move relative to the body portion as the legs move.

3. The amusement device of claim 1, wherein the motor causes the animal portion to walk forward or backward.

4. The amusement device of claim 1, the animal portion further comprising a speaker that plays a sound.

5. The amusement device of claim 4, the animal portion further comprising a memory that stores the sound that is played by the speaker.

6. The amusement device of claim 1, wherein the animal portion further comprises a head motor connected to the head, which head motor causes the head to move.

7. The amusement device of claim 1, wherein the tongue has a magnetic end portion.

8. The amusement device of claim 7, further comprising an object that magnetically connects to the magnetic end portion of the tongue.

9. A remote-controlled animal amusement device comprising:

a body;

a head connected to the body, the head comprising:

a lower jaw that defines a mouth;

a tongue connected to the head inside the mouth, the tongue comprising:

a plurality of elongated lattice members pivotally connected to each other;

a stationary connector connected to one of the plurality of members;

a slidable connector connected to another of the plurality of members, wherein the slidable connector moves relative to the stationary connector causing the tongue to extend as the slidable connector moves away from the stationary connector and causing the tongue to retract as the slidable connector moves toward the stationary connector.

10. The amusement device of claim 9, further comprising a motor connected to the slidable connector, which motor causes the slidable connector to move.

11. The amusement device of claim 10, further comprising a remote control comprising:

a feature selection button;

an electronics portion connected to the button that creates a signal based on an input from the button; and a transmitter connected to the electronics portion that transmits a signal to a receiver connected to the motor, which signal causes the tongue to extend or retract.

12. The amusement device of claim 9, further comprising a fly object that removably attaches to the tongue.

13. The amusement device of claim 9, further comprising a magnetic object that removably attaches to the tongue.

14. An interactive remote-controlled amusement device comprising:

an animal portion that receives a signal, the animal portion comprising:

a body portion having a non-magnetic outer shell;

a motor connected to the body portion; and a magnetic portion inside the outer shell; and a magnetic object that magnetically attaches to the outer shell through a field created by the magnetic portion.

wherein the magnetic portion is movable within the outer shell and is configured to be capable of moving the magnetic object while the maqnetic object remains in contact with the outer shell.

15. The device of claim 14, wherein the magnetic portion is coupled to moving parts, wherein the moving parts are legs connected to the body portion.

16. The device of claim 14, further comprising a remote control that sends a signal to the animal portion.

* * * * *